US008261640B2

(12) United States Patent
Wu

(10) Patent No.: US 8,261,640 B2
(45) Date of Patent: Sep. 11, 2012

(54) REVERSIBLE OPEN END WRENCH HAVING RETAINING PROPERTY

(75) Inventor: Arthur Wu, Taichung County (TW)

(73) Assignee: Proxene Tools Co., Ltd, Taichung (TW)

( * ) Notice: Subject to any disclaimer, the term of this patent is extended or adjusted under 35 U.S.C. 154(b) by 315 days.

(21) Appl. No.: 12/647,378

(22) Filed: Dec. 24, 2009

(65) Prior Publication Data

US 2011/0120273 A1 May 26, 2011

(30) Foreign Application Priority Data

Nov. 25, 2009 (TW) ..... 98140172 A

(51) Int. Cl.
*B25B 13/28* (2006.01)

(52) U.S. Cl. ..... 81/186; 81/111; 81/179

(58) Field of Classification Search ..... 81/186, 81/119, 178, 179, 126, 125, 185.2, 111, 98, 81/99

See application file for complete search history.

(56) References Cited

U.S. PATENT DOCUMENTS

| | | | | |
|---|---|---|---|---|
| 3,641,847 | A * | 2/1972 | Horton | 81/179 |
| 3,717,054 | A * | 2/1973 | Thompson | 81/179 |
| 4,889,020 | A * | 12/1989 | Baker | 81/119 |
| 6,158,309 | A * | 12/2000 | Baker | 81/186 |
| 6,443,038 | B2 * | 9/2002 | Hsieh | 81/119 |
| 7,418,891 | B2 * | 9/2008 | Choi | 81/111 |

* cited by examiner

*Primary Examiner* — Hadi Shakeri

(57) ABSTRACT

A reversible open end wrench includes a handle, a head and a retainer. The head includes a first jaw, a second jaw and an extension section. The jaws and the extension section define a driving area therebetween. The first jaw has a first engaging surface and a distal end. The second jaw has a second engaging surface. The horizontal distance between the two engaging surfaces is s. The retainer is disposed on the distal end and has a retaining end extending toward the driving area. The retaining end is movable between a first position and a second position. As the retaining end locates at the first position, the horizontal distance between the retaining end and the second engaging surface is smaller than s. As the retaining end locates at the second position, the horizontal distance between the retaining end and the second engaging surface is no smaller than s.

12 Claims, 9 Drawing Sheets

REVERSIBLE OPEN END WRENCH HAVING RETAINING PROPERTY

BACKGROUND OF THE INVENTION

1. Field of the Invention

The present invention relates to a hand tool, and more particularly to a reversible open end wrench having retaining property.

2. Description of the Prior Art

A conventional reversible open end wrench mainly includes two jaws for driving a nut in one direction and running idle in the other direction. As the wrench applies forces on the nut, the nut sometimes tends to slip away from the driving area.

The present invention is, therefore, arisen to obviate or at least mitigate the above mentioned disadvantages.

SUMMARY OF THE INVENTION

The main object of the present invention is to provide a reversible open end wrench that can prohibit a nut from disengaging therefrom during a turning stroke.

To achieve the above and other objects, the reversible open end wrench of the present invention includes a handle, a head and a retainer. The head is disposed at one end of the handle. The head has a first jaw, a second jaw and an extension section extending between the first and second jaws. The jaws and the extension section define a driving area therebetween for a hexagonal nut to receive therein. The driving area has an opening away from the extension section. The first jaw has a first engaging surface, a concave revolving surface and a distal end. The first engaging surface is adjacent to the extension section. A joint section between the first engaging surface and the extension section is formed with an abutting angle for receiving a corner of the hexagonal nut therein. The revolving surface locates between the first engaging surface and the distal end. The second jaw has a second engaging surface. The distal end has a short plane surface facing the second jaw. A horizontal distance between the first and second engaging surfaces is s, and a horizontal distance between the short plane surface and the second engaging surface is no smaller than s. The retainer is disposed on the distal end and has a retaining end extending toward the driving area. The retaining end is movable between a first position and a second position.

When the retaining end locates at the first position, a vertical distance between the retaining end and the abutting angle is bigger than 0.58 s, and a horizontal distance between the retaining end and the second engaging surface is smaller than s.

When the retaining end locates at the second position, the horizontal distance between the retaining end and the second engaging surface is no smaller than s.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
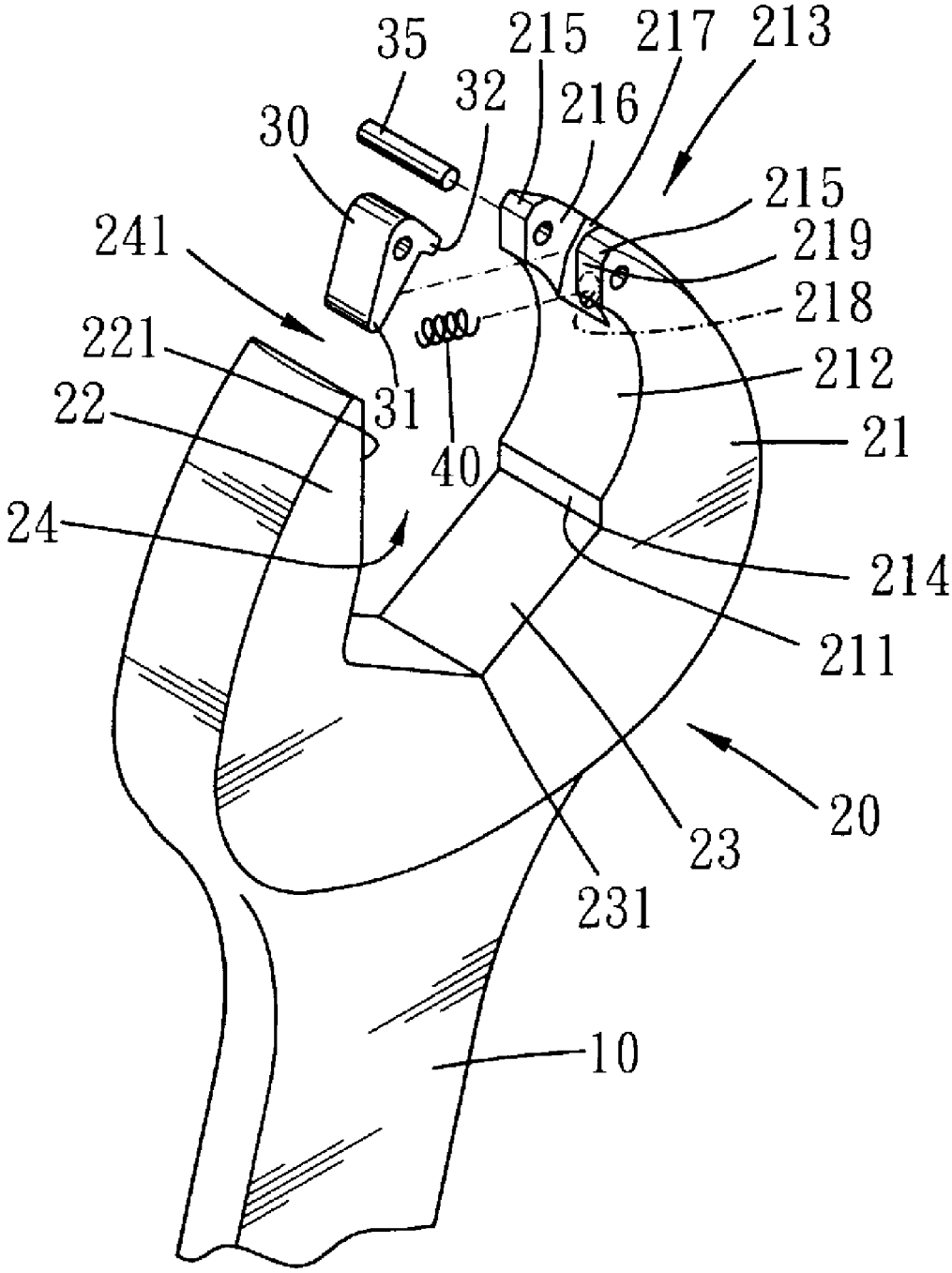
FIG. 1 is a breakdown drawing showing a first preferred embodiment of the present invention.
Figure 2:
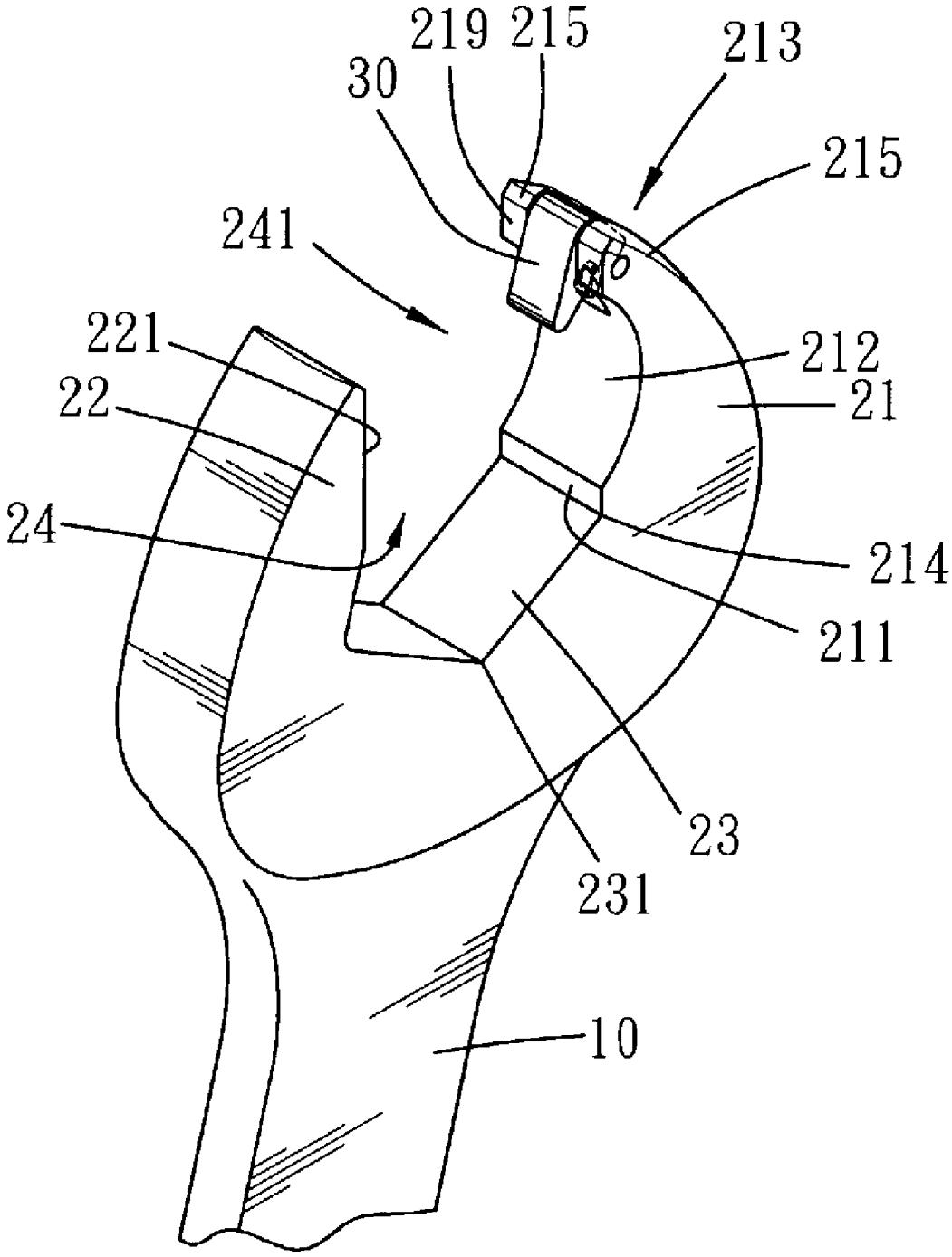
FIG. 2 is a combination drawing showing a first preferred embodiment of the present invention.

Please refer to FIG. 1 to FIG. 4 for the first embodiment of the present invention. A reversible open end wrench of the present embodiment includes a handle 10, a head 20, a retainer 30 and a resilient member 40.

The handle 10 is adapted for the user to hold. At least one end of the handle 10 is formed with the head 20. The head 20 has a first jaw 21, a second jaw 22 and an extension section 23 extending between bottoms of the jaws 21 and 22. The jaws 21 and 22 and the extension section 23 define a driving area 24 therebetween for a hexagonal nut 5 to receive therein. The driving area 24 has an opening 241 away from the extension section 23. The first jaw 21 has a first engaging surface 211 adjacent to the extension section 23, a concave revolving surface 212 and a distal end 213. A joint section between the first engaging surface 211 and the extension section 23 is formed with an abutting angle 214 for receiving a corner of the hexagonal nut 5 therein. Thus the abutting angle 214 is preferably a concave angle of 120 degrees. The extension section 23 has a lowest position 231 for a corner of the hexagonal nut 5 to abut thereagainst. In the present embodiment, the distal end 213 includes a pair of arms 215 and a dividing slot 216 locating between the arms 215. A bottom surface of the dividing slot 216 is an abutting surface 217. The distal end 213 is further formed with a receiving bore 218. Moreover, the revolving surface 212 locates between the first engaging surface 211 and the distal end 213, and the revolving surface 212 is preferably a concave arc surface. The distal end 213 has a short plane surface 219 facing the second jaw 22. The second jaw 22 has a second engaging surface 221. A horizontal distance between the first and second engaging surfaces 211 and 221 is s, and a horizontal distance between the short plane surface 219 and the second engaging surface 221 is no smaller than s. In addition, the maximum horizontal distance between the revolving surface 212 and the second engaging surface 221 is preferably no smaller than 1.16 s, in which a length between two opposite sides of the hexagonal nut 5 is slightly smaller than s.

As such, the nut 5 can enter the driving area 24 from the opening 241. When the wrench is turned clockwise, the nut 5 can be clamped by the engaging surfaces 211 and 221 and be driven clockwise. When the wrench is turned reversely, a corner of the nut 5 can revolve along the revolving surface 212 so that the wrench can run idle for the user to continuously and rapidly stroke the hexagonal nut 5.

The retainer 30 is disposed on the distal end 213. In the present embodiment, the retainer 30 is pivoted between the arms 215 and is swayable about an axle 35 disposed on the arms 215. The retainer 30 has a retaining end 31 extending toward the driving area 24 and an abutting end 32 extending therefrom. The retaining end 31 is movable between a first position and a second position. As the retaining end 31 locates at the first position, the abutting end 32 abuts against the abutting surface 217 so that the retaining end 31 cannot further sway outward.

The resilient member 40 is disposed in the receiving bore 218 for urging the retaining end 31 back to the first position.

Figure 3:
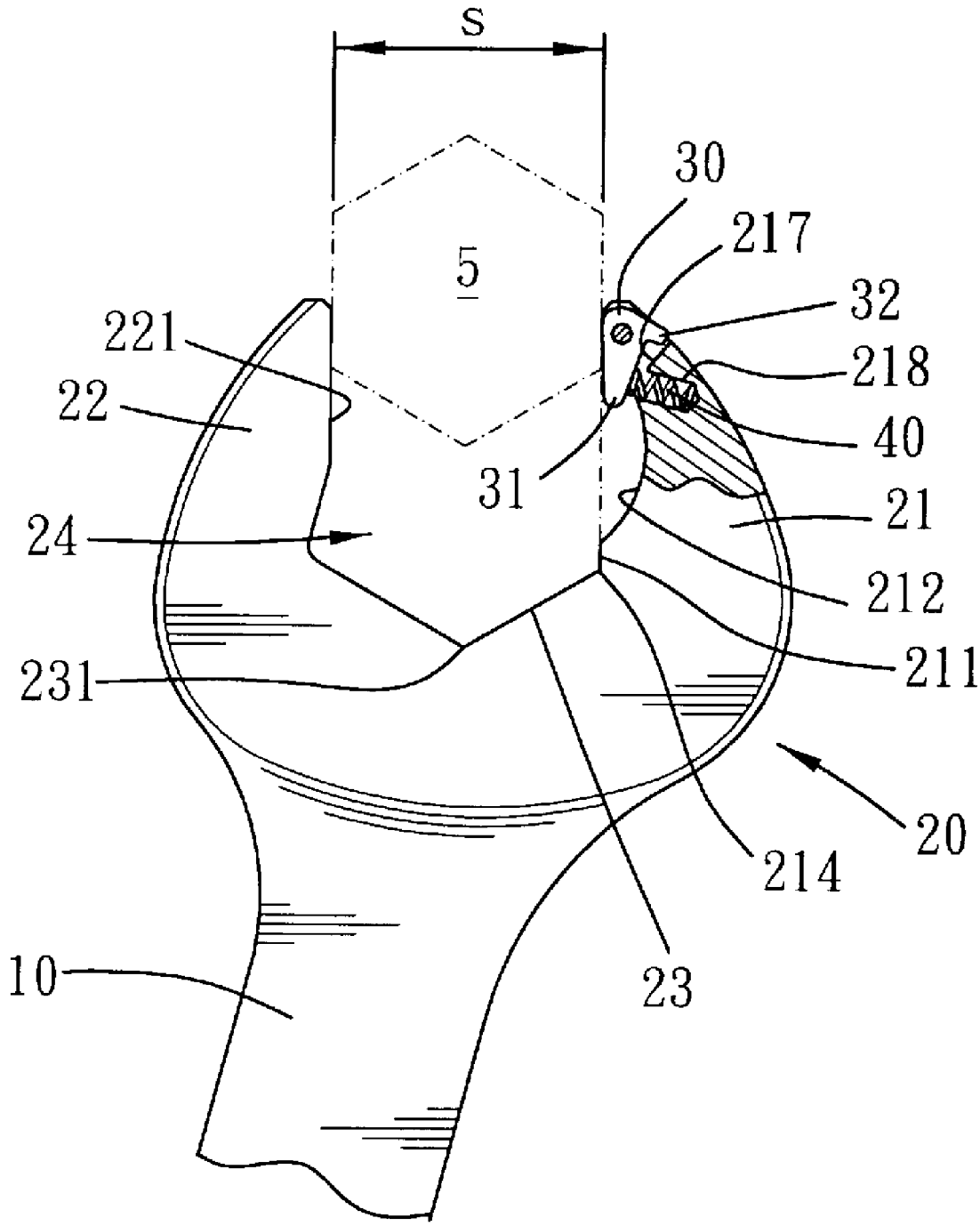
FIG. 3 is a front view showing a first preferred embodiment with its retaining end locating at the second position.
Figure 4:
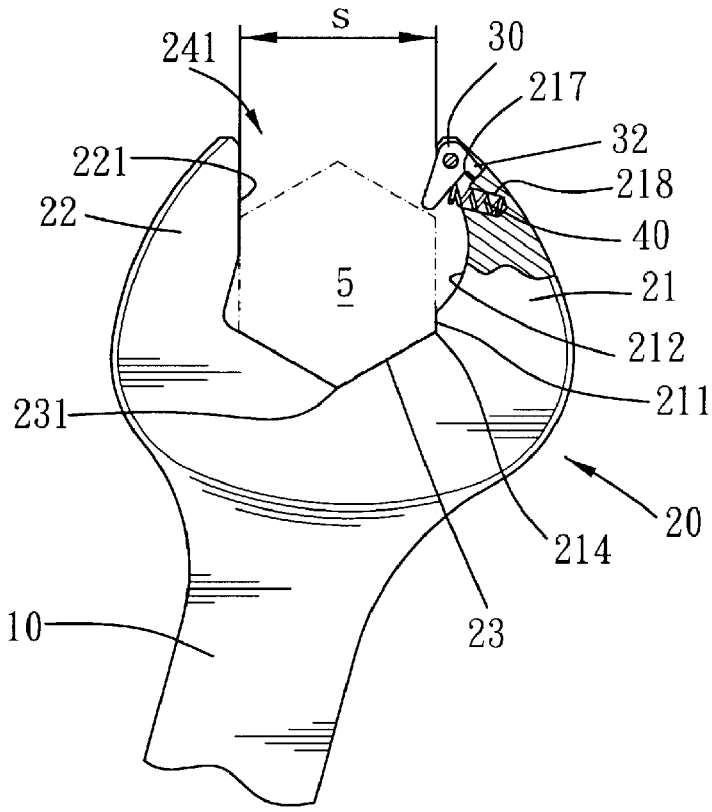
FIG. 4 is a front view showing a first preferred embodiment with its retaining end locating at the first position.

Please refer to FIG. 3. As the nut 5 enters the driving area 24 from the opening 241, the nut 5 presses the retainer 30 and pushes the retaining end 31 to sway to the second position. In this case, a horizontal distance between the retaining end 31 and the second engaging surface 221 is no smaller than s so that the nut 5 can successfully enter the driving area 24. Once the nut 5 has entered the driving area as shown in FIG. 4, the resilient member 40 pushes the retaining end 31 back to the first position. In this case, a vertical distance between the retaining end 31 and the abutting end 214 is slightly bigger than 0.58 s, and a vertical distance between the retaining end 31 and the lowest position 231 is slightly bigger than 0.87 s. Further, the horizontal distance between the retaining end 31 and the second engaging surface 221 is smaller than s.

Figure 5:
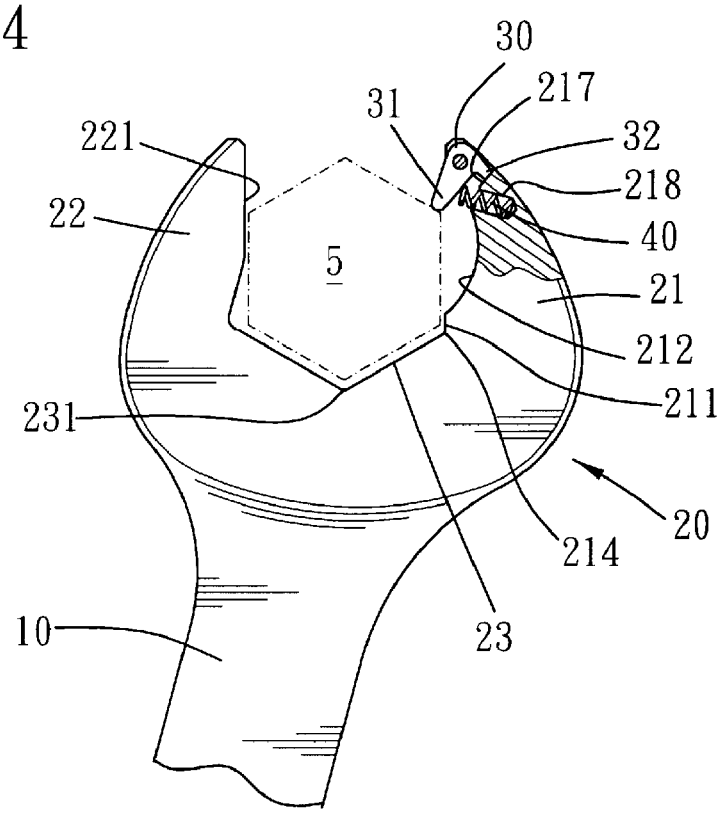
FIG. 5 is a front view showing a first preferred embodiment with its retaining end retaining a hexagonal nut.

Please refer to FIG. 5. When the hexagonal nut 5 is driven, the nut 5 sometimes tends to slip toward the opening 241. Because the horizontal distance between the retaining end 31 and the second engaging surface 221 is smaller than s, and further because the abutting end 32 abuts against the abutting surface 217, the hexagonal nut 5 is retained by the retaining end 31 and does not disengage from the wrench. Nevertheless, when the wrench is reversely turned, a corner of the nut 5 can still press the retaining end 31 to push it from the first position to the second position because the abutting end 32 does not abut against the abutting surface 217 in such direction. As such, the wrench will have no trouble running idle in the reverse direction.

Figure 5A:
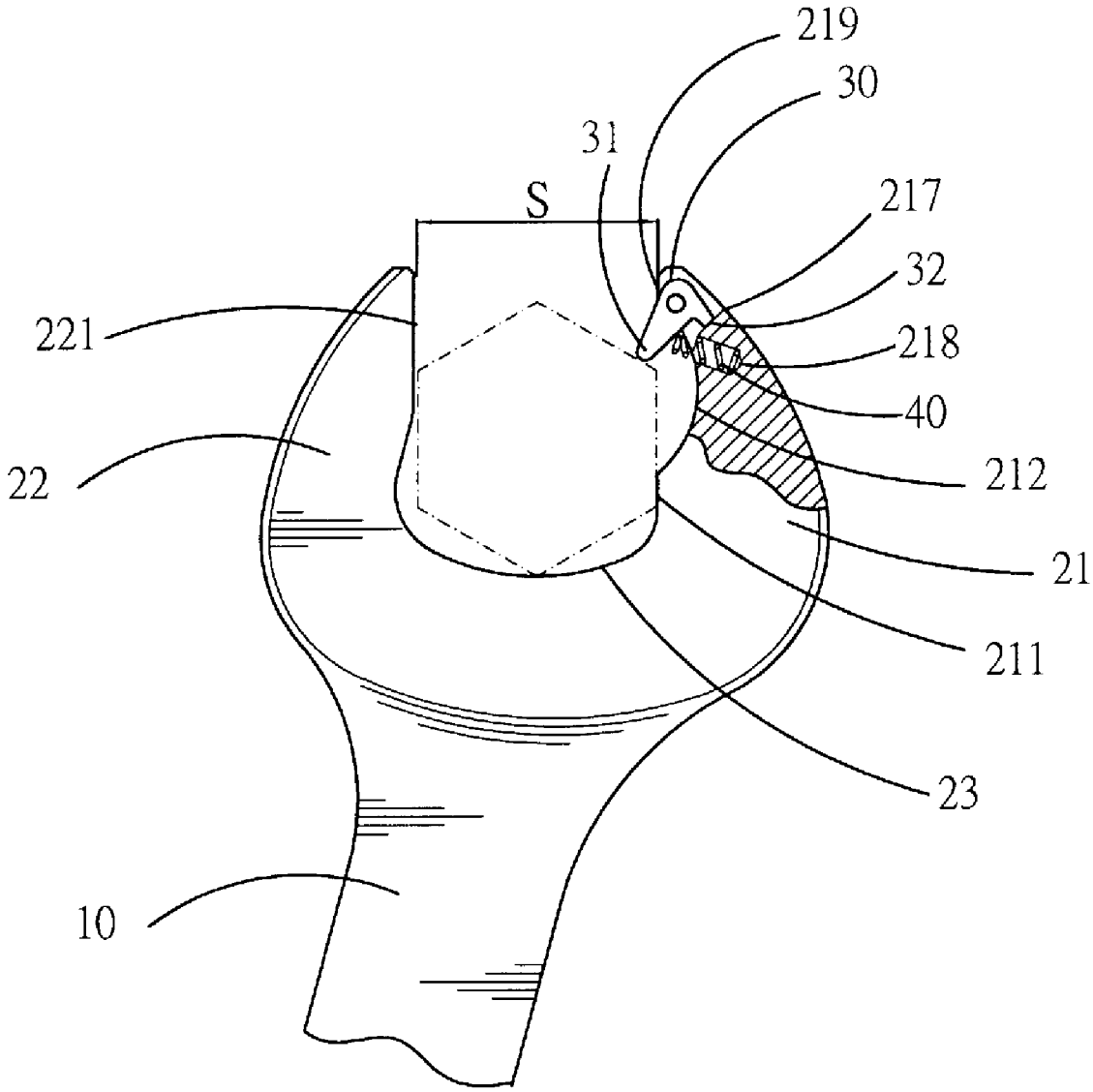
FIG. 5A is a front view showing another preferred embodiment of the present invention.
Figure 5C:
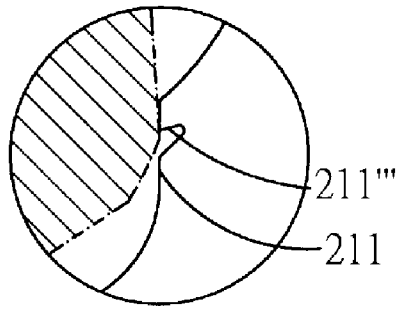
FIG. 5C is an enlarged drawing of FIG. 5B.
Figure 5B:
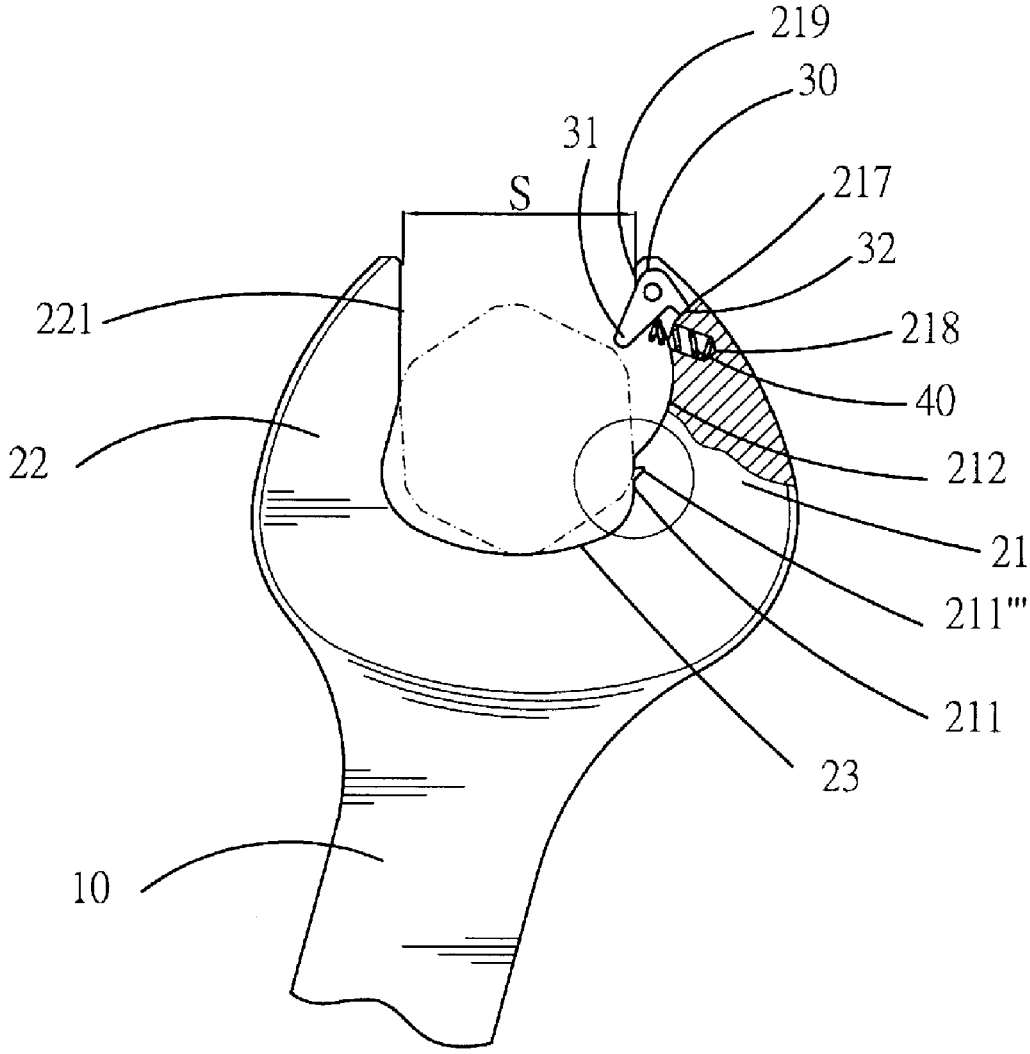
FIG. 5B is a front view showing yet another preferred embodiment of the present invention.

In other embodiments of the present invention, the extension section 23 can be designed in a concave arc shape as shown in FIG. 5A, and a plain first engaging surface 211 is provided between the extension section 23 and the revolving surface 212. As shown in FIG. 5B and FIG. 5C, the first engaging surface 211 may be provided with at least one tooth 211''' for biting a rounded hexagonal nut. The tooth 211''' may locate adjacent to or at least close to the revolving surface 212.

Figure 6:
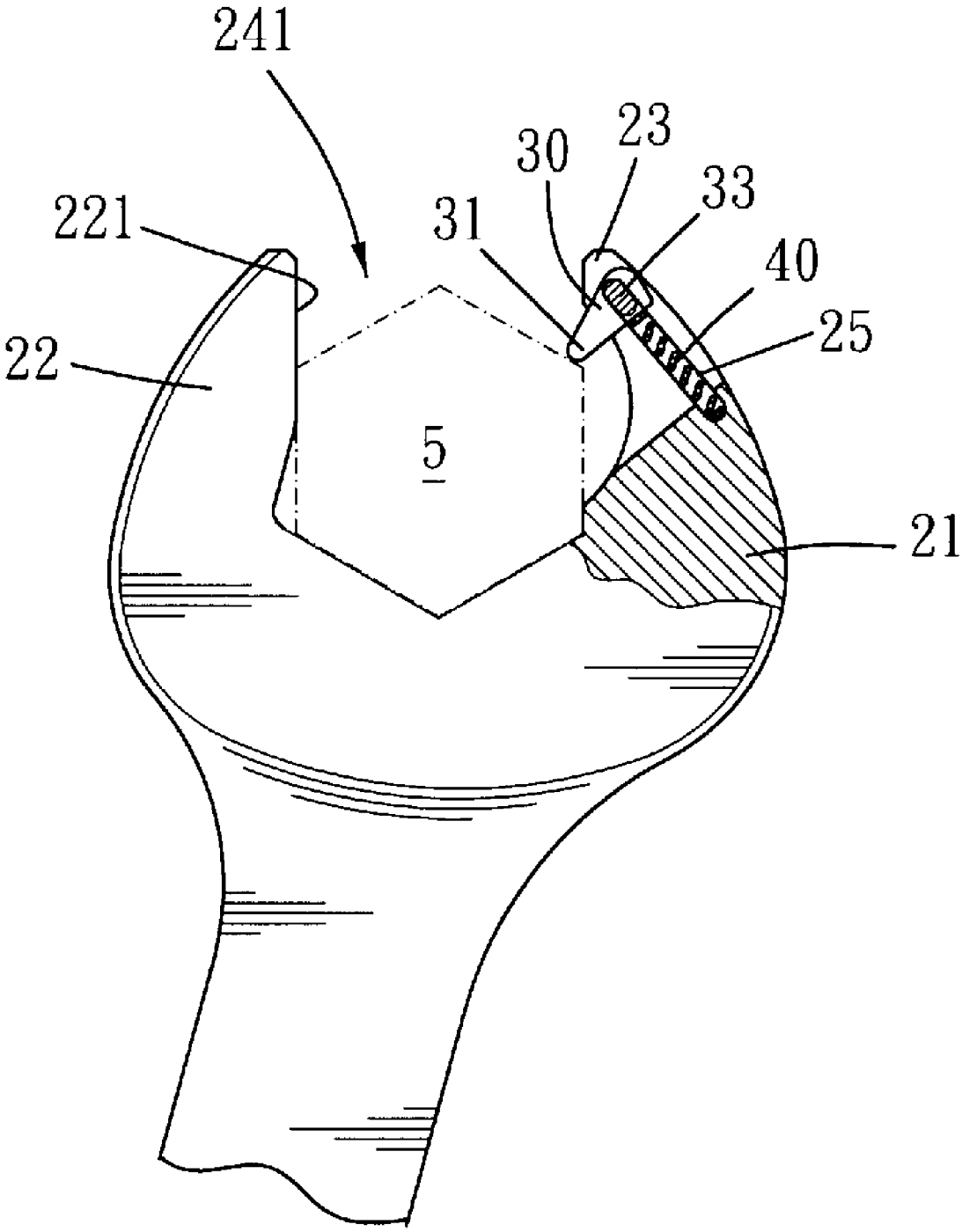
FIG. 6 is a front view showing a second preferred embodiment with its retaining end locating at the first position.
Figure 7:
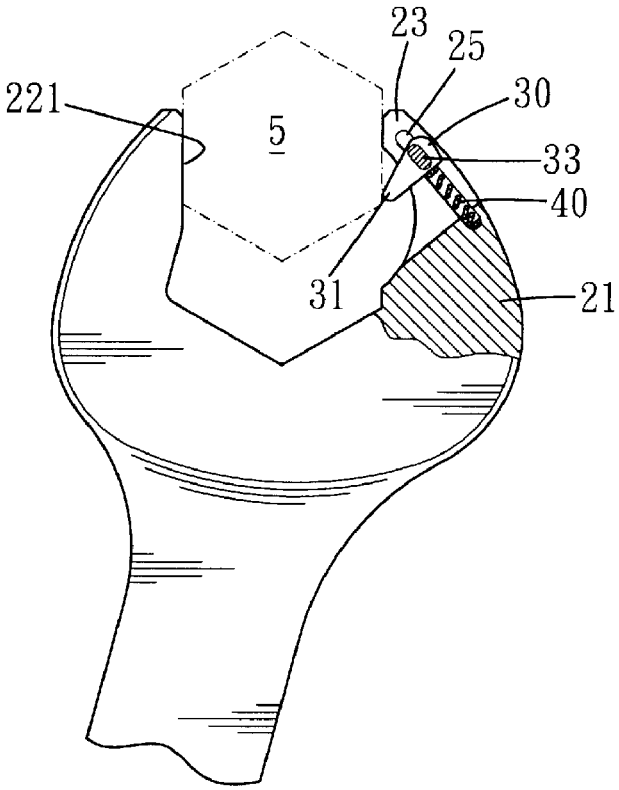
FIG. 7 is a front view showing a second preferred embodiment with its retaining end locating at the second position.
Figure 8:
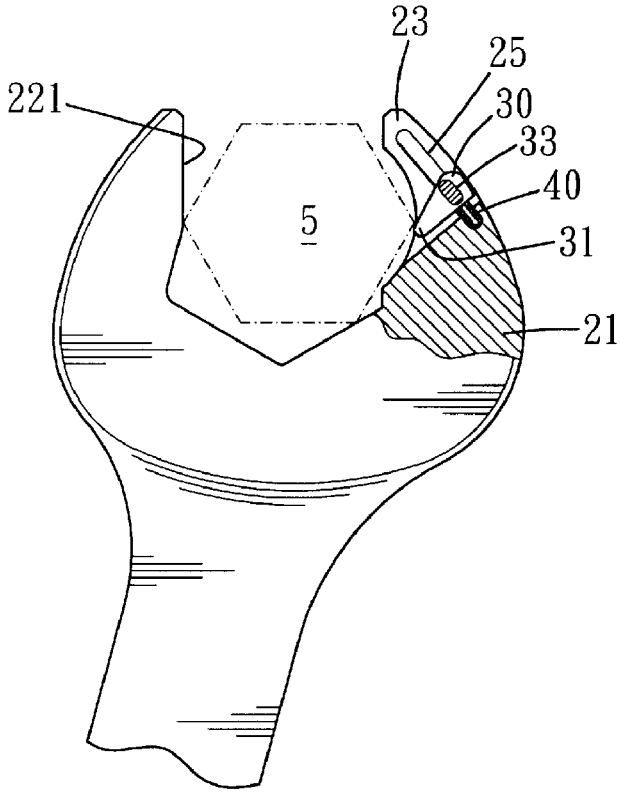
FIG. 8 is a front view showing a second preferred embodiment with its retaining end locating at the third position.

Please refer to FIG. 6 to FIG. 8 for the second embodiment of the present invention. The first jaw 21 further has a sliding slot 25 extending from the distal end 213 to a position away from the opening 241, and the retainer 30, on the other hand, has a sliding boss 33 slidably inserted into the sliding slot 25. The resilient member 40 is disposed in the sliding slot 25 and abuts against the sliding boss 33. As such, the retaining end 31 can move along the orientation of the sliding slot 25 between the first and second positions, as shown in FIG. 6 and FIG. 7 respectively. It is to be noted that the sliding boss 33 exactly locates at an upper end of the sliding slot 25 as the retaining end 31 locates at the first position, so that the retaining end 31 will not further move outward. In order to provide sufficient room for the hexagonal nut 5 to revolve, the retaining end 31 may further move to a third position, as shown in FIG. 8. In such case, the horizontal distance between the retaining end 31 and the second engaging surface 221 is preferably no smaller than 1.16 s.

Figure 9:
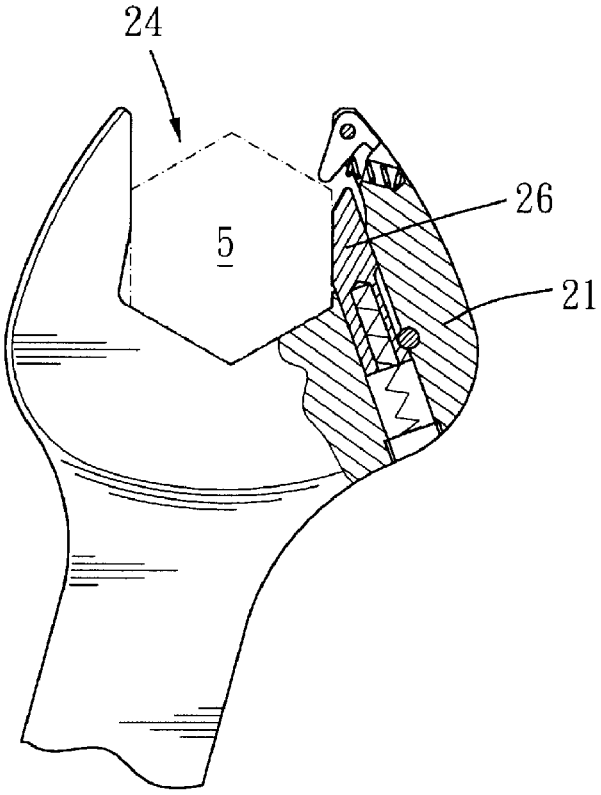
FIG. 9 is a front view showing a third preferred embodiment with its retaining end locating at the first position.
Figure 10:
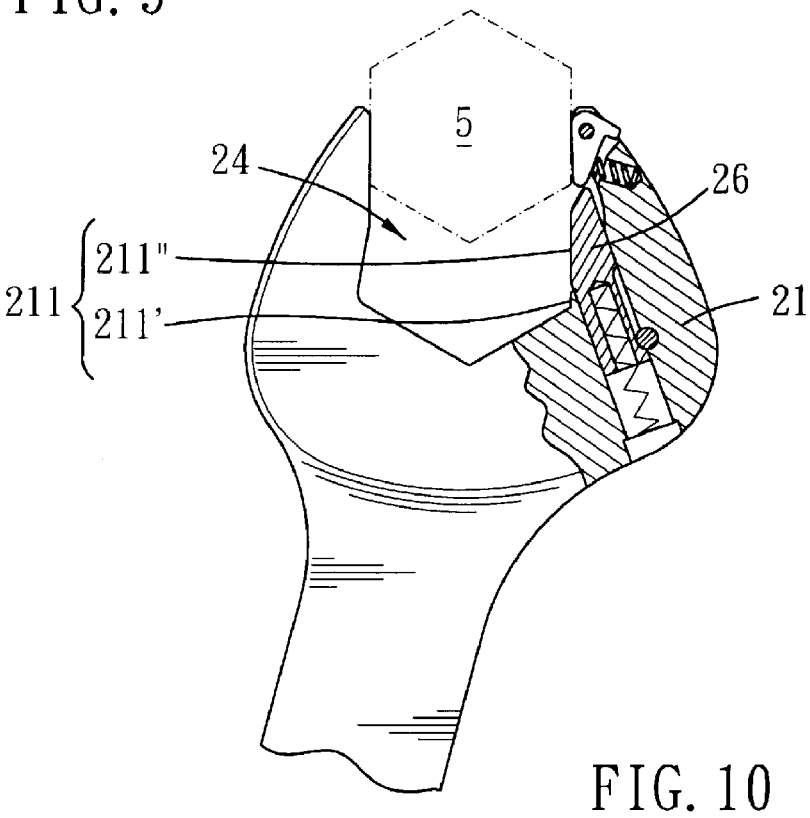
FIG. 10 is a front view showing a third preferred embodiment with its retaining end locating at the second position.

Please refer to FIG. 9 and FIG. 10 for the third embodiment of the present invention. The first jaw 21 can be further provided with a slidable rod 26 selectively inserting into the driving area 24. The slidable rod 26 is adapted for the hexagonal nut 5 to abut thereagainst as the wrench turns clockwise, and the slidable rod 26 can withdraw from the driving area 24 as the wrench strokes reversely for the nut 5 to revolve with respect to the wrench. In the present embodiment, the first engaging surface 211 of the first jaw 21 includes a main engaging surface 211' integrally formed on the first jaw 21 and a sub engaging surface 211" formed on the slidable rod 26. Further, the sub engaging surface 211" flushes with the main engaging surface 211' as the slidable rod 26 inserts into the driving area 24.

In summarization, the present invention provides the reversible open end wrench with a retainer, which is movable between the first position and the second (or third) position. On one hand, the hexagonal nut can be fitted into the driving area from the opening without barriers. On the other hand, the retainer prohibits the nut from slipping out of the driving area during the turning stroke of the wrench. As such, the working efficiency as well as the safety performance of the reversible open end wrench of the present invention can be readily ensured.

What is claimed is:

1. A reversible open end wrench, comprising:

a handle;

a head, disposed at one end of the handle, the head having a first jaw, a second jaw and an extension section extending between the first and second jaws, the first and second jaws and the extension section defining a driving area therebetween for a hexagonal nut to receive therein, the driving area having an opening away from the extension section, the first jaw having a first engaging surface, a concave revolving surface and a distal end, the first engaging surface being adjacent to the extension section, a joint section between the first engaging surface and the extension section being formed with an abutting angle for receiving a corner of the hexagonal nut therein, the revolving surface locating between the first engaging surface and the distal end, the second jaw having a second engaging surface, the distal end having a short plane surface facing the second jaw, a horizontal distance between the first and second engaging surfaces being s, a horizontal distance between the short plane surface and the second engaging surface being no smaller than s;

a retainer, disposed on the distal end and having a retaining end extending toward the driving area, the retaining end being movable between a first position and a second position;

a resilient member for urging the retaining end back to the first position;

wherein when the retaining end locates at the first position, a vertical distance between the retaining end and the abutting angle is bigger than 0.58 s, and a horizontal distance between the retaining end and the second engaging surface is smaller than s;

wherein when the retaining end locates at the second position, the horizontal distance between the retaining end and the second engaging surface is no smaller than s;

wherein in when the wrench is turned toward a specific direction, the nut received in the driving area is able to be clamped by the first engaging surface and the second engaging surface and to be driven to turn;

wherein when the wrench is turned toward an opposite direction, a corner of the nut is able to revolve along the revolving surface, a corner of the nut is able to press the retaining end to push the retaining end from the first position to the second position.

2. The wrench of claim 1, wherein the retainer is pivoted on the distal end, the retainer further has an abutting end extending therefrom, and the distal end has an abutting surface, when the retaining end locates at the first position, the abutting end abuts against the abutting surface.

3. The wrench of claim 1, wherein the first jaw further has a sliding slot extending from the distal end to a position away from the opening, the retainer further has a sliding boss slidably inserted into the sliding slot.

4. The wrench of claim 3, wherein the retaining end can be further moved to a third position, when the retaining end locates at the third position, the horizontal distance between the retaining end and the second engaging surface is no smaller than 1.16 s.

5. The wrench of claim 1, wherein the first jaw further has a slidable rod selectively inserting into the driving area, the slidable rod is adapted for the hexagonal nut to abut thereagainst.

6. The wrench of claim 1, wherein the first engaging surface is provided with at least one tooth for biting a rounded hexagonal nut.

7. A reversible open end wrench, comprising;

a handle;

a head, disposed at one end of the handle, the head having a first jaw, a second jaw and an extension section extending between the first and second jaws, the first and second jaws and the extension section defining a driving area therebetween for a hexagonal nut to receive therein, the driving area having an opening away from the extension section, the first jaw having a first engaging surface, a concave revolving surface and a distal end, the first engaging surface being adjacent to the extension section, the extension section having a lowest position for a corner of the hexagonal nut to abut thereagainst, the revolving surface locating between the first engaging surface and the distal end, the second jaw having a second engaging surface, the distal end having a short plane surface facing the second jaw, a horizontal distance between the first and second engaging surface being s, a horizontal distance between the short plane surface and the second engaging surface being no smaller than s;

a retainer, disposed on the distal end and having a retaining end extending toward the driving area, the retaining end being movable between a first position and a second position;

a resilient member for urging the retaining end back to the first position;

wherein when the retaining end locates at the first position, a vertical distance between the retaining end and the lowest position is bigger than 0.87 s, and a horizontal distance between the retaining end and the second engaging surface is smaller than s;

wherein when the retaining end locates at the second position, the horizontal distance between the retaining end and the second engaging surface is no smaller than s;

wherein when the wrench is turned toward a specific direction, the nut received in the driving area is able to be clumped by the first engaging surface and the second engaging surface and to be driven to turn;

wherein when the wrench is turned toward an opposite direction, a corner of the nut is able to revolve along the revolving surface, a corner of the nut is able to press the retaining end to push the retaining end from the first position to the second position.

8. The wrench of claim 7, wherein the retainer is pivoted on the distal end, the retainer further has an abutting end extending therefrom, and the distal end has an abutting surface, when the retaining end locates at the first position, the abutting end abuts against the abutting surface.

9. The wrench of claim 7, wherein the first jaw further has a sliding slot extending from the distal end to a position away from the opening, the retainer further has a sliding boss slidably inserted into the sliding slot.

10. The wrench of claim 9, wherein the retaining end can be further moved to a third position, when the retaining end locates at the third position, the horizontal distance between the retaining end and the second engaging surface is no smaller than 1.16 s.

11. The wrench of claim 7, wherein the first jaw further has a slidable rod selectively inserting into the driving area, the slidable rod is adapted for the hexagonal nut to abut thereagainst.

12. The wrench of claim 7, wherein the first engaging surface is provided with at least one tooth for biting a rounded hexagonal nut.

* * * * *